US009414457B2

(12) United States Patent
Fukuda et al.

(10) Patent No.: US 9,414,457 B2
(45) Date of Patent: Aug. 9, 2016

(54) LIGHTING DEVICE, LUMINAIRE, AND LIGHTING SYSTEM

(71) Applicant: Panasonic Intellectual Property Management Co., Ltd., Osaka (JP)

(72) Inventors: Kenichi Fukuda, Osaka (JP); Sana Yagi, Osaka (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 0 days.

(21) Appl. No.: 14/831,398

(22) Filed: Aug. 20, 2015

(65) Prior Publication Data

US 2016/0073469 A1 Mar. 10, 2016

(30) Foreign Application Priority Data

Sep. 9, 2014 (JP) ..... 2014-183715

(51) Int. Cl.
*H05B 33/08* (2006.01)

(52) U.S. Cl.
CPC ..... *H05B 33/0857* (2013.01); *H05B 33/0815* (2013.01)

(58) Field of Classification Search
CPC .... H05B 37/02; H05B 33/08; H05B 33/0815; H05B 33/0833; H05B 33/0845; H05B 33/0851; H05B 33/0866; H05B 33/0809
USPC ..... 315/200 R, 201, 209 R, 210, 224, 291, 315/297, 299, 307, 308
See application file for complete search history.

(56) References Cited

U.S. PATENT DOCUMENTS

| | | | | |
|---|---|---|---|---|
| 8,508,141 | B2 | 8/2013 | Takeda et al. | |
| 8,810,141 | B2 | 8/2014 | Takeda et al. | |
| 9,131,581 | B1 * | 9/2015 | Hsia | H05B 33/0815 |
| 2004/0085030 | A1 * | 5/2004 | Laflamme | H05B 33/0863 315/291 |
| 2011/0260633 | A1 | 10/2011 | Takeda et al. | |
| 2012/0153836 | A1 | 6/2012 | Shimizu | |
| 2013/0009560 | A1 | 1/2013 | Takeda et al. | |
| 2013/0141013 | A1 | 6/2013 | Kodama et al. | |
| 2013/0234622 | A1 * | 9/2013 | Tanaka | H01L 25/0753 315/307 |
| 2013/0241428 | A1 | 9/2013 | Takeda | |
| 2013/0328503 | A1 * | 12/2013 | Toda | H05B 37/02 315/297 |

FOREIGN PATENT DOCUMENTS

| | | | |
|---|---|---|---|
| JP | 2004-111104 | A | 4/2004 |
| JP | 2005-268000 | A | 9/2005 |
| JP | 2011-165400 | A | 8/2011 |

(Continued)

*Primary Examiner* — Thai Pham
(74) *Attorney, Agent, or Firm* — Renner, Otto, Boisselle & Sklar, LLP

(57) ABSTRACT

A lighting device includes: a first input terminal for receiving an AC voltage phase-controlled by a first phase-control dimmer; a first light source unit which emits light of a first color; a second light source unit which emits light of a second color different from the first color; a control circuit which controls a total amount of light emitted from the first and second light source units and the color of combined light including the light emitted from the first and second light source units. The control signal includes first and second control information. The first control information is for controlling either one of the total amount of light and the color of combined light, and corresponds to the conduction angle of the first phase-control dimmer. The second control information is for controlling the other of the total amount of light and the color of combined light.

14 Claims, 10 Drawing Sheets

(56) References Cited

FOREIGN PATENT DOCUMENTS

| | | | |
|---|---|---|---|
| JP | 2012-134001 | A | 7/2012 |
| JP | 2012-146623 | A | 8/2012 |
| JP | 2012-146633 | A | 8/2012 |
| JP | 2012-199218 | A | 10/2012 |
| JP | 2013-012455 | A | 1/2013 |
| JP | 2013-012459 | A | 1/2013 |

* cited by examiner

LIGHTING DEVICE, LUMINAIRE, AND LIGHTING SYSTEM

CROSS REFERENCE TO RELATED APPLICATION

This application claims the benefit of priority of Japanese Patent Application Number 2014-183715, filed Sep. 9, 2014, the entire content of which is hereby incorporated by reference.

BACKGROUND OF THE INVENTION

1. Field of the Invention

The present disclosure relates to: a lighting device which supplies current to a solid-state light-emitting element; a luminaire including the lighting device; and a lighting system.

2. Description of the Related Art

There is a conventional method for performing color control and dimming in a lighting system including solid-state light emitting elements such as light emitting diodes (LEDs) as a light source (for example, see Patent Literature (PTL) 1: Japanese Unexamined Patent Application Publication No. 2012-134001). In the conventional method, a plurality of solid-state light emitting elements which emit different colors are combined to perform color control and dimming according to an external dimming signal.

PTL 1 discloses an LED driving device used in combination with a phase-control dimmer, and a method for controlling the amount of light and the color of light output from a load LED in coordination with each other, according to the conduction angle of the waveform output from the phase-control dimmer.

SUMMARY OF THE INVENTION

The LED driving device disclosed in PTL 1 attempts to control the amount of light and the color of light output from the LED in coordination with each other by simply connecting two external lines. In the LED driving device disclosed in PTL 1, however, the relationship between the amount of light and the color of light is limited to a one-to-one correspondence. Hence, a user cannot select a desired combination of the amount of light and color of light.

The present disclosure has been conceived in order to solve such a conventional problem. An object of the present disclosure is to provide a lighting device and the like which are capable of being turned on with a desired combination of the amount of light and the color of light.

In order to achieve the above described objet, a lighting device according to one aspect of the present disclosure includes: a first input terminal for receiving an AC voltage phase-controlled by a first phase-control dimmer; a first current supply unit which supplies a first current to a first light source unit which emits light of a first color; a second current supply unit which supplies a second current to a second light source unit which emits light of a second color different from the first color; a control circuit which controls a total light amount and a color of combined light by adjusting a level of the first current and a level of the second current, the total light amount being a total amount of the light emitted from the first light source unit and the light emitted from the second light source unit, the combined light including the light emitted from the first light source unit and the light emitted from the second light source unit; and a signal supply unit which supplies a control signal to the control circuit. The control signal includes first control information and second control information. The first control information is information for controlling either one of the total light amount and the color of the combined light, and corresponds to a conduction angle of the first phase-control dimmer. The second control information is information for controlling an other one of the total light amount and the color of the combined light.

With such a configuration, it is possible to provide a lighting device and the like which are capable of being turned on with a desired combination of the amount of light and the color of light.

BRIEF DESCRIPTION OF DRAWINGS

The figures depict one or more implementations in accordance with the present teaching, by way of examples only, not by way of limitations. In the figures, like reference numerals refer to the same or similar elements.

DETAILED DESCRIPTION OF THE PREFERRED EMBODIMENTS

Figure 1:
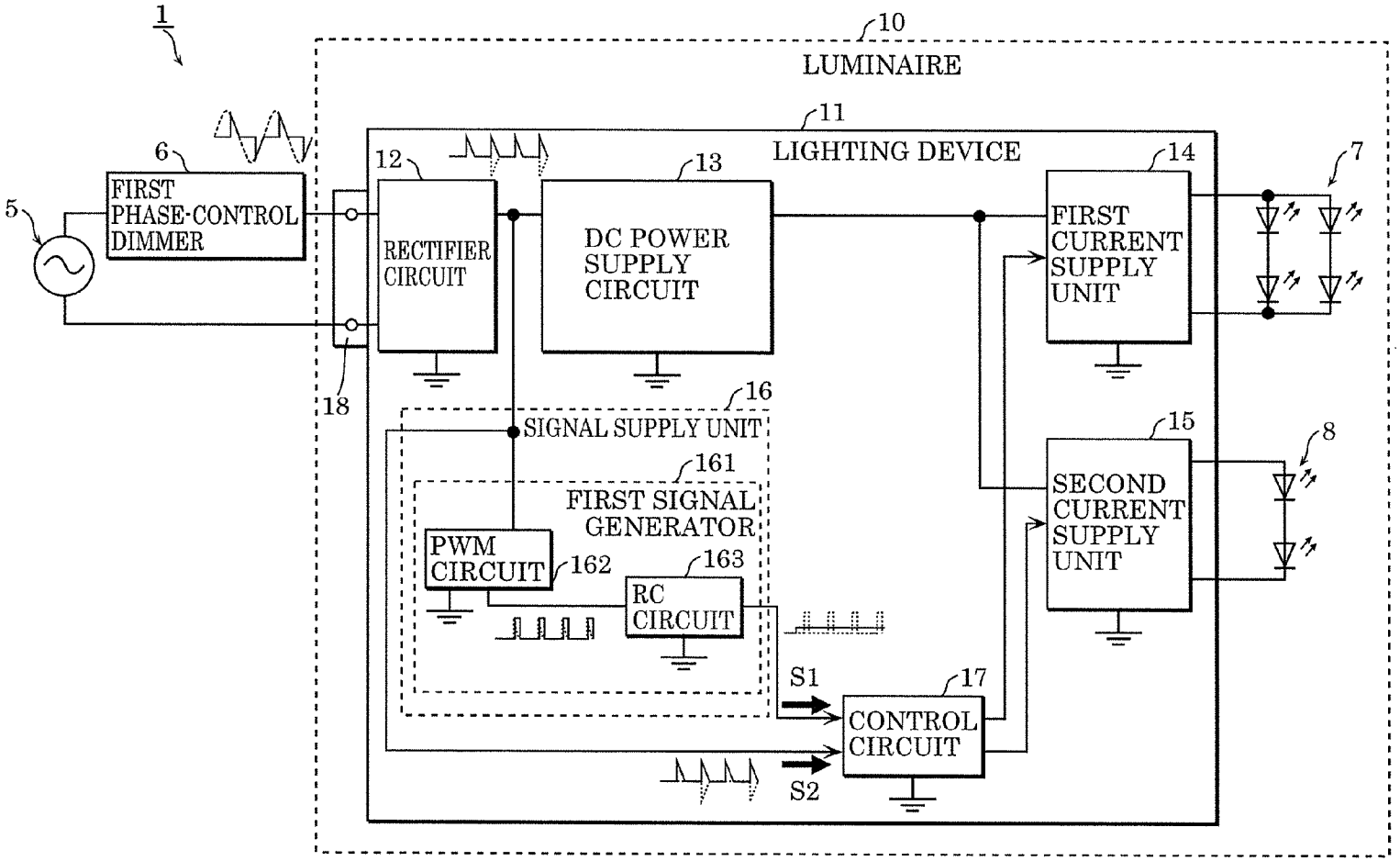
FIG. 1 is a block diagram of a functional configuration of a lighting system according to Embodiment 1.

Hereinafter, a lighting device, a luminaire, and a lighting system according to embodiments of the present disclosure will be described with reference to the drawings.

It should be noted that each of the following embodiments shows one specific example of the present disclosure. The numerical values, structural elements, the arrangement and connection of the structural elements etc., shown in the following embodiments are mere examples, and therefore do not limit the present disclosure. As such, among the structural elements in the following embodiments, structural elements not recited in any one of the independent claims which indicate the broadest concepts of the present disclosure are described as arbitrary structural elements.

Note that the respective figures are schematic diagrams and are not necessarily precise illustrations. Additionally, substantially the same structural elements share like reference numbers in the drawings, and duplicated descriptions are omitted or simplified.

Embodiment 1

[1-1. Overall Configuration of Lighting System]

First, configurations of a lighting device, a luminaire, and a lighting system according to Embodiment 1 will be described.

FIG. 1 is a block diagram of a functional configuration of lighting system 1 according to Embodiment 1. Note that FIG. 1 also illustrates AC power supply 5 (for example, commercial power supply) which generates AC voltage input to lighting system 1.

As FIG. 1 illustrates, lighting system 1 includes first phase-control dimmer 6 and luminaire 10.

First phase-control dimmer 6 is a dimmer which performs phase control on the supplied AC voltage and outputs phase-controlled AC voltage. In lighting system 1 according to Embodiment 1, first phase-control dimmer 6 performs dimming on luminaire 10 by controlling the phase angle (conduction angle) to be supplied to luminaire 10 out of the AC voltage supplied from AC power supply 5 to first phase-control dimmer 6. Moreover, first phase-control dimmer 6 according to Embodiment 1 includes a switch capable of switching between continuation and blockage of supply of voltage to luminaire 10 independently of phase control. The switch allows a user to easily turn on and off luminaire 10.

Luminaire 10 is an apparatus which can be turned on with a desired amount of light and a desired color of light, and includes first light source unit 7, second light source unit 8, and lighting device 11.

First light source unit 7 is a light source which emits light of a first color. In Embodiment 1, first light source unit 7 includes an LED module which outputs light of a color temperature of 2000 K.

Second light source unit 8 is a light source which emits light of a second color different from the first color. In Embodiment 1, second light source unit 8 includes an LED module which outputs light of a color temperature of 8000 K.

Lighting device 11 is a device which turns on first light source unit 7 and second light source unit 8 by supplying current to first light source unit 7 and second light source unit 8. Lighting device 11 includes: first input terminal 18; rectifier circuit 12; DC power supply circuit 13; first current supply unit 14; second current supply unit 15; signal supply unit 16; and control circuit 17.

First input terminal 18 is a terminal for receiving AC voltage phase-controlled by first phase-control dimmer 6.

Rectifier circuit 12 is a circuit which rectifies the AC voltage input via first input terminal 18. Rectifier circuit 12 includes, for example, a diode bridge. Rectifier circuit 12 may further include a filter which blocks high-frequency noise.

DC power supply circuit 13 is a circuit which smoothes voltage including pulsating current input from rectifier circuit 12 to generate DC voltage.

First current supply unit 14 is a circuit which supplies a first current to first light source unit 7. First current supply unit 14 includes, for example, a DC/DC convertor. The first current supplied from first current supply unit 14 is controlled by control circuit 17.

Second current supply unit 15 is a circuit which supplies a second current to second light source unit 8. Second current supply unit 15 includes, for example, a DC/DC convertor. The second current supplied from second current supply unit 15 is controlled by control circuit 17.

Signal supply unit 16 is a circuit which supplies a signal to control circuit 17. The voltage output from rectifier circuit 12 is applied to signal supply unit 16. Signal supply unit 16 generates first control signal S1 and second control signal S2 based on the applied voltage, and inputs the generated signals to control circuit 17. Signal supply unit 16 includes first signal generator 161 which generates first control signal S1 based on the voltage applied from rectifier circuit 12, and outputs the generated signal to control circuit 17. Signal supply unit 16 inputs the voltage applied from rectifier circuit 12 to control circuit 17 as second control signal S2. Signal supply unit 16 may include a voltage converting circuit which generates second control signal S2 by converting the voltage applied from rectifier circuit 12 to voltage suitable to input to control circuit 17. The voltage converting circuit may be, for example, a voltage dividing circuit.

First signal generator 161 includes pulse width modulation (PWM) circuit 162 and RC circuit 163.

PWM circuit 162 is a circuit which generates a PWM signal based on the voltage waveform rectified by rectifier circuit 12. PWM circuit 162 compares the applied voltage with a determination reference value, and outputs a pulse signal based on the result of the comparison. Here, the pulse signal output is a PWM signal synchronized with the AC voltage phase-controlled by first phase-control dimmer 6.

RC circuit 163 smoothes the PWM signal input from PWM circuit 162 and inputs first control signal S1 which is DC voltage to control circuit 17.

First control signal S1 input from signal supply unit 16 to control circuit 17 is used for supplying, to control circuit 17, first control information which is related to the level of dimming (conduction angle) by first phase-control dimmer 6. Second control signal S2 is used for supplying, to control circuit 17, second control information which is related to a time period during which the switch of first phase-control dimmer 6 is off (non-conducting state).

Control circuit 17 is a circuit which controls: the total amount of light emitted from first light source unit 7 and second light source unit 8; and the color of combined light including the light emitted from first light source unit 7 and second light source unit 8, by adjusting the level of the first current to be supplied to first light source unit 7 and the level of second current to be supplied to second light source unit 8. Control circuit 17 includes a micro-control unit (MCU). For example, as control circuit 17, a microprocessor RL78/I1A manufactured by Renesas Electronics may be used. Control circuit 17 performs control based on the control signal input from signal supply unit 16. For example, control circuit 17 performs AD conversion on the control signal into a digital signal, and performs control based on the digital signal. Control circuit 17 stores, in an internal memory, characteristic tables each used for changing the total amount of light and the color of combined light in coordination with each other. Here, the characteristic table is a table indicating a relationship between first control information, an output signal to first current supply unit 14, and an output signal to second current supply unit 15. Various kinds of the characteristic tables are stored, and one of the characteristic tables is selected based on the second control information. Control circuit 17 outputs, based on the selected characteristic table, an output signal corresponding to the first control information to first current supply unit 14, and an output signal corresponding to the first control information to second current supply unit 15.

[1-2. Operation of Lighting Device]

Next, an operation of lighting device 11 according to Embodiment 1 will be described.

First, control of the total amount of light and the color of combined light output from lighting device 11 will be briefly described.

Figure 2:
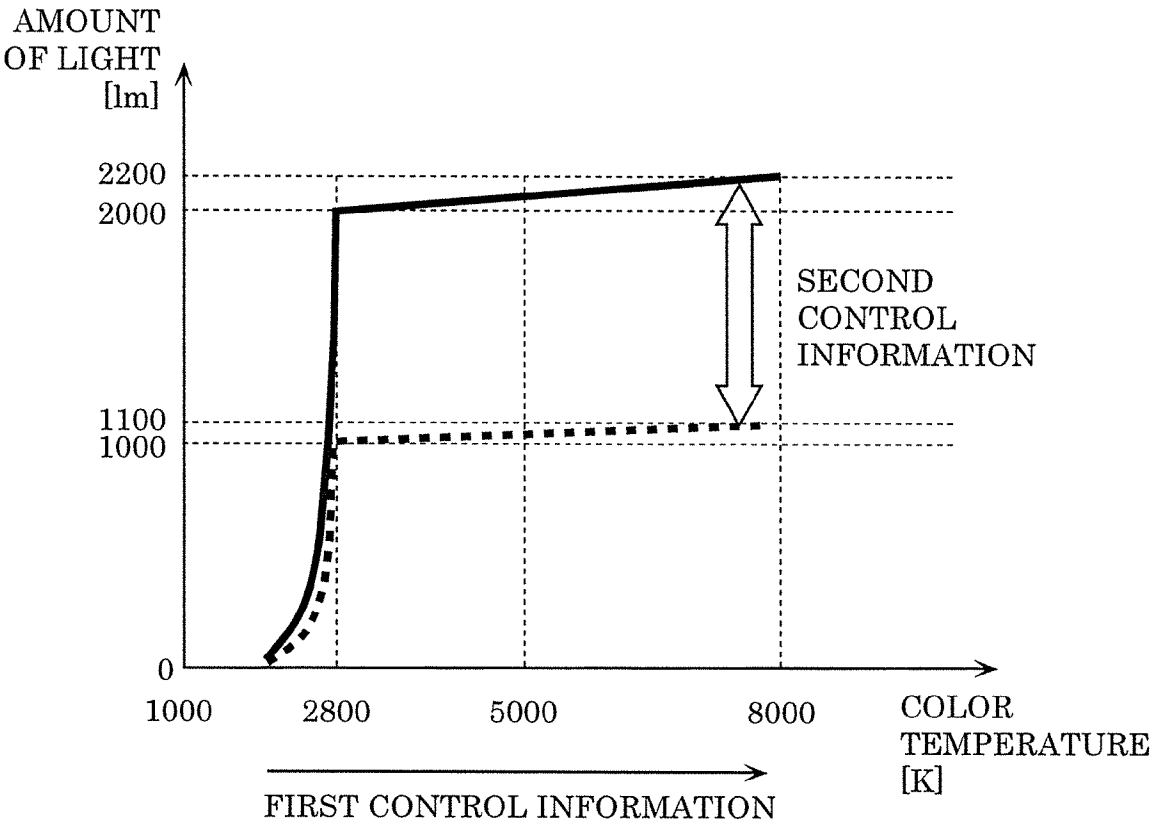
FIG. 2 is a graph illustrating correspondence relationships between the total amount of light output from a luminaire according to Embodiment 1 and the color of combined light output from the luminaire.

As described above, control circuit 17 stores a plurality of characteristic table each indicating a relationship between first control information, an output signal to first current supply unit 14, and an output signal to second current supply unit 15. Referring to FIG. 2, a correspondence relationship, between the total amount of light and the color of combined light output from luminaire 10, determined based on one of the characteristic tables will be described.

FIG. 2 is a graph indicating correspondence relationships between the total amount of light and the color of combined light output from luminaire 10 according to Embodiment 1. In the graph of FIG. 2, correspondence relationships, between the total amount of light and the color of combined light, corresponding to two characteristic tables are indicated by a solid line and a dashed line. The correspondence relationships between the total amount of light and the color of combined light illustrated in FIG. 2 are determined so that the relationships are perceived as comfortable by humans.

As FIG. 2 illustrates, a plurality of characteristic tables define a plurality of correspondence relationships in each of which the total amount of light and the color of combined light are in a one-to-one correspondence. One of the characteristic tables is selected based on second control information included in second control signal S2 input to control circuit 17. Here, control circuit 17 reads, from the selected characteristic table, an output signal to first current supply unit 14 and an output signal to second current supply unit 15. The output signals correspond to the first control information. Control circuit 17 inputs respective output signals to first current supply unit 14 and second current supply unit 15. Accordingly, a predetermined total amount of light and combined light of a predetermined color are output from first light source unit 7 and second light source unit 8.

As described above, in luminaire 10 according to Embodiment 1, the total amount of light and the color of combined light are controlled based on the first and second control information. As FIG. 2 illustrates, in Embodiment 1, control circuit 17 includes a plurality of characteristic tables in each of which the color temperature of the combined light has a positive correlation with the total amount of light. Each characteristic table has a different total amount of light corresponding to the color of combined light. For example, in the example illustrated in FIG. 2, the characteristic indicated by a solid line has a total amount of light for each color of combined light twice as high as the characteristic indicated by a dashed line.

In Embodiment 1, a characteristic table is selected based on the second control information. In other words, in Embodiment 1, the total amount of light is controlled based on the second control information.

In Embodiment 1, the color of combined light is controlled based on the first control information. As a result of the change in color of the combined light, the total amount of light is also changed accordingly based on the characteristic table. Accordingly, it can be said that the color of combined light and the total amount of light are controlled based on the first control information.

Next, an operation of lighting device 11 for obtaining the first and second control information will be described referring to the drawings. Of the operation, first, phase control of AC voltage performed by first phase-control dimmer 6 will be described referring to FIG. 3.

Figure 3:
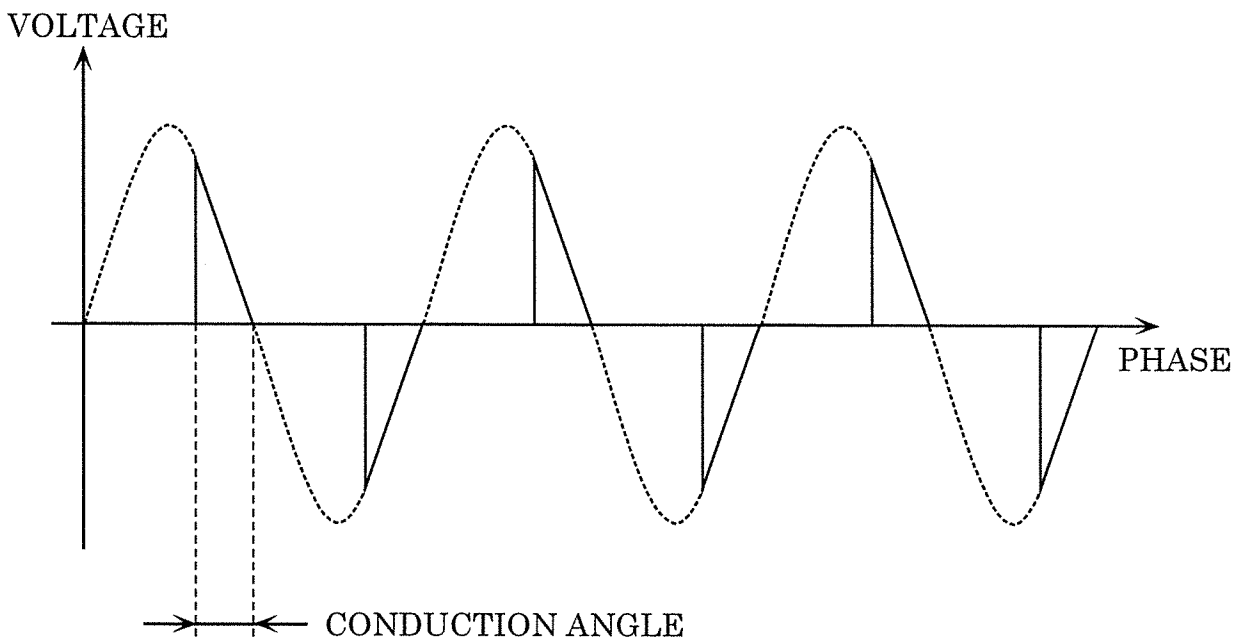
FIG. 3 is a graph of examples of voltage waveforms generated by a first phase-control dimmer according to Embodiment 1.

FIG. 3 is a graph indicating examples of voltage waveforms generated by first phase-control dimmer 6 according to Embodiment 1. Here, the horizontal axis of the graph illustrated in FIG. 3 indicates a phase. In the graph of FIG. 3, the waveform of the AC voltage before phase control is indicated by a dashed line, and the voltage waveform after the phase control is indicated by a solid line.

As FIG. 3 illustrates, each half cycle of the AC voltage has a conduction angle which corresponds to the AC voltage output from first phase-control dimmer 6. The other phases do not have the AC voltage output from first phase-control dimmer 6. First phase-control dimmer 6 adjusts the output voltage by controlling the magnitude of the conduction angle, and inputs the output voltage to lighting device 11 to perform dimming.

Next, an operation of rectifier circuit 12 will be described referring to FIG. 4A.

Figure 4A:
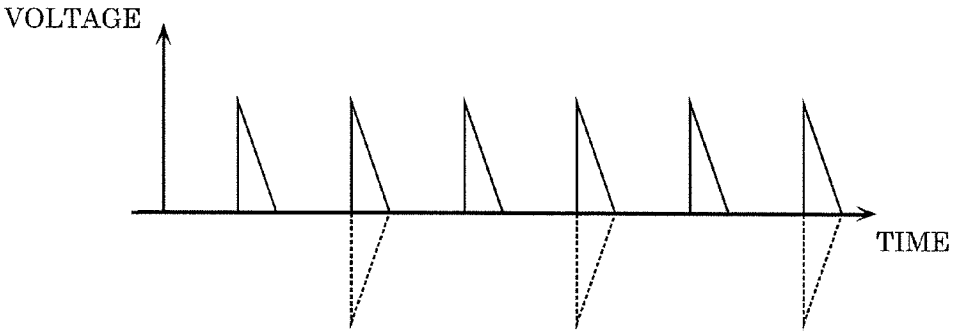
FIG. 4A is a graph of examples of temporal waveforms of input voltage and output voltage in a rectifier circuit according to Embodiment 1.

FIG. 4A is a graph illustrating examples of temporal waveforms of input voltage and output voltage in rectifier circuit 12 according to Embodiment 1. Here, in the graph of FIG. 4A, the input voltage waveform is indicated by a dashed line and the output voltage waveform is indicated by a solid line.

As FIG. 4A illustrates, rectifier circuit 12 rectifies the phase-controlled AC voltage input, and outputs the rectified AC voltage.

Next, an operation of PWM circuit 162 will be described referring to FIG. 4B.

Figure 4B:
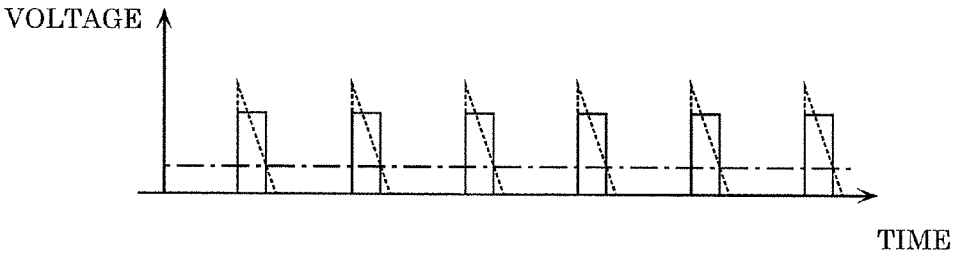
FIG. 4B is a graph of examples of temporal waveforms of input voltage and output voltage in a PWM circuit according to Embodiment 1.

FIG. 4B is a graph illustrating examples of the temporal waveforms of input voltage and output voltage in PWM circuit 162 according to Embodiment 1. Here, in the graph of FIG. 4B, the input voltage waveform is indicated by a dashed line and the output voltage waveform is indicated by a solid line. The peak voltage of the output voltage waveform is determined according to the characteristics of control circuit 17 which receives the output voltage waveform.

As FIG. 4B illustrates, PWM circuit 162 compares the input voltage with a determination reference value. The dot-and-dash line in the graph of FIG. 4B indicates the level of the determination reference value. When the input voltage is higher than the determination reference value, PWM circuit 162 outputs high-level voltage. When the input voltage is lower than the determination reference value, PWM circuit 162 outputs low-level voltage. Accordingly, the PWM signal as illustrated in FIG. 4B is output from PWM circuit 162.

Next, an operation of RC circuit 163 will be described referring to FIG. 4C.

Figure 4C:
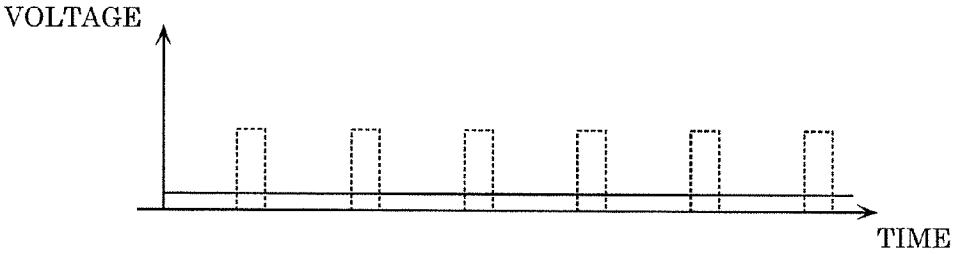
FIG. 4C is a graph of examples of temporal waveforms of input voltage and output voltage in an RC circuit according to Embodiment 1.

FIG. 4C is a graph illustrating examples of the temporal waveforms of input voltage and output voltage in RC circuit 163 according to Embodiment 1. Here, in the graph of FIG. 4C, the input voltage waveform is indicated by a dashed line and the output voltage waveform is indicated by a solid line.

As FIG. 4C illustrates, the PWM signal input to RC circuit 163 is smoothed by RC circuit 163, and is output as DC voltage. Accordingly, control circuit 17 receives first control signal S1 including DC voltage as illustrated in FIG. 4C. Here, the DC voltage has a value corresponding to the conduction angle of first phase-control dimmer 6. Control circuit 17 detects the DC voltage of first control signal S1, and obtains the value of the DC voltage as the first control information. As described above, in Embodiment 1, the first control information is a value corresponding to the conduction angle of first phase-control dimmer 6. The color of the combined light and the total amount of light are controlled so as to have a positive correlation with the conduction angle.

Next, an operation of control circuit 17 for obtaining the second control information from second control signal S2 will be described.

As FIG. 1 illustrates, control circuit 17 receives the signal output from rectifier circuit 12, as second control signal S2. Control circuit 17 detects the time period during which the switch of first phase-control dimmer 6 is off, based on second control signal S2. Control circuit 17 monitors the time interval at which the voltage of second control signal S2 input becomes less than or equal to a predetermined value, in order to detect the above time period. Here, when the switch of first phase-control dimmer 6 is on, the time interval at which the voltage of second control signal S2 becomes less than or equal to the predetermined value is less than or equal to a half cycle of AC power supply 5, and when the switch is off, the time interval is greater than the half cycle of AC power supply 5. By using this, when the time interval at which the voltage of second control signal S2 is less than or equal to the predetermined value is longer than the half cycle of AC power supply 5, control circuit 17 determines that the switch of first phase-control dimmer 6 is off and detects the time period during which the switch is off (off period Toff). Control circuit 17 obtains, as the second control information, the off period Toff, during which the switch of first phase-control dimmer 6 is off, detected in the above manner.

Here, an example of control in which control circuit 17 selects one of the characteristic tables based on the second control information will be described referring to FIG. 5A, FIG. 5B, and FIG. 5C.

Figure 5A:
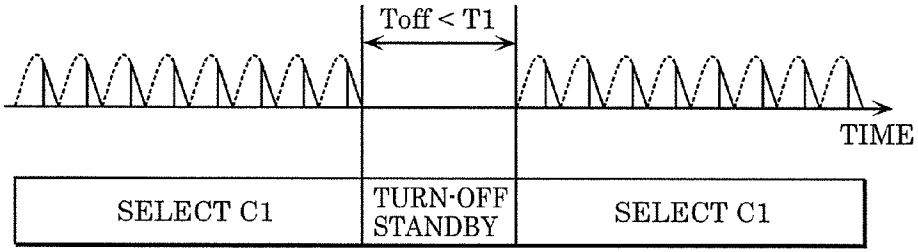
FIG. 5A illustrates an operation of a control circuit when an off period, during which the first phase-control dimmer according to Embodiment 1 is off, is less than T1.
Figure 5B:
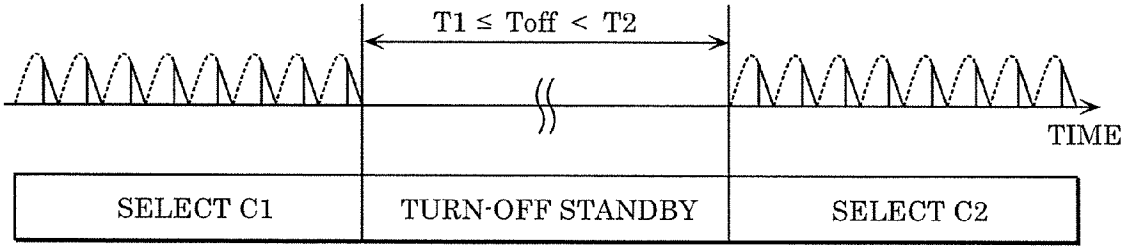
FIG. 5B illustrates an operation of the control circuit when the off period, during which the first phase-control dimmer according to Embodiment 1 is off, is greater than or equal to T1 and less than T2.
Figure 5C:
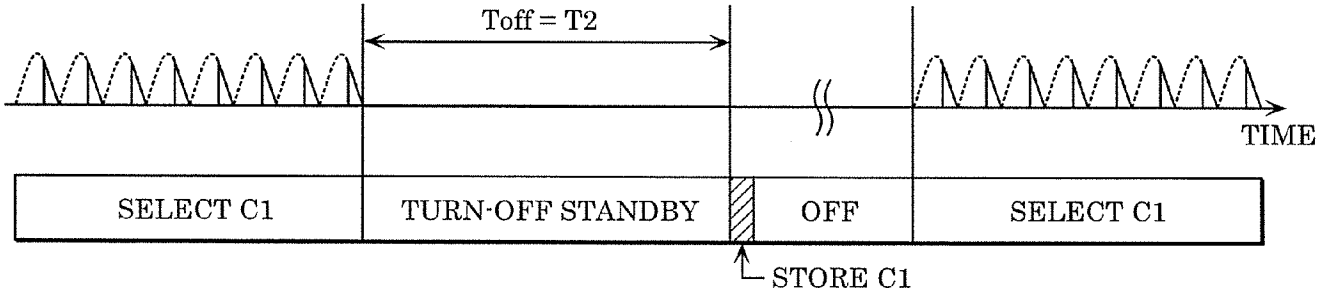
FIG. 5C illustrates an operation of the control circuit when the off period, during which the first phase-control dimmer according to Embodiment 1 is off, is greater than or equal to T2.

FIG. 5A, FIG. 5B, and FIG. 5C each illustrate an operation of control circuit 17 when off period Toff, during which first phase-control dimmer 6 is off, is less than T1, greater than or equal to T1 and less than T2, and greater than or equal to T2. In the examples in FIG. 5A, FIG. 5B, and FIG. 5C, characteristic table C1 is being selected before the switch of first phase-control dimmer 6 is turned off.

Here, when control circuit 17 of lighting device 11 detects that the switch of first phase-control dimmer 6 has been turned off, control circuit 17 causes first current supply unit 14 to stop supplying current to first light source unit 7 and causes second current supply unit 15 to stop supplying current to second light source unit 8. Accordingly, lighting device 11 is turned off, and light output from luminaire 10 is stopped. However, control circuit 17 stands by without ending control till off period Toff exceeds a predetermined time period (second time period to be described later) even if the switch of first phase-control dimmer 6 is turned off (see FIG. 5A, FIG. 5B, and FIG. 5C).

As FIG. 5A illustrates, when off period Toff is less than first period T1, control circuit 17 does not determine that the switch is turned off intentionally by the user, and maintains the state where characteristic table C1 is being selected. Here, first period T1 is, for example, set to 0.2 seconds.

As FIG. 5B illustrates, when off period Toff has a value greater than or equal to first period T1, and less than second period T2 (>T1), control circuit 17 determines that the switch has been turned off and on intentionally by the user to change the characteristic table, and changes the characteristic table for selection from C1 to C2. Control circuit 17 then controls the total amount of light and the color of combined light based on characteristic table C2. Here, second period T2 is, for example, set to one second. How to change the characteristic table is not particularly limited, but, for example, it may be that the selection order of characteristic tables is determined, and a characteristic table is selected according to the determined order when the switch is operated.

As FIG. 5C illustrates, when off period Toff is greater than or equal to second period T2, control circuit 17 determines that a normal turn-off operation has been performed by the user. When off period Toff is greater than or equal to second period T2, control circuit 17 stores, in the memory, the characteristic table which is currently being selected (characteristic table C1 in FIG. 5C), and stops control operation. Control circuit 17 selects the stored characteristic table by referring to the memory, when the lighting device is turned on next time.

In the example described above, only the second control information is used for selection of a characteristic table, but the first control information may also be used. For example, when the conduction angle corresponding to the first control information has a value within a predetermined range, and when off period Toff corresponding to the second control information is within a predetermined range, a predetermined characteristic table may be selected. With such a configuration, for example, when a plurality of lighting devices 11 are controlled by single first phase-control dimmer 6, a predetermined characteristic table can be selected by lighting devices 11. In other words, the correspondence relationship between the total amount of light and the color of combined light of each lighting device 11 can be set to a predetermined relationship.

[1-3. Variation of Embodiment 1]

Next, Variation of lighting system 1 according to Embodiment 1 will be described referring to FIG. 6.

Figure 6:
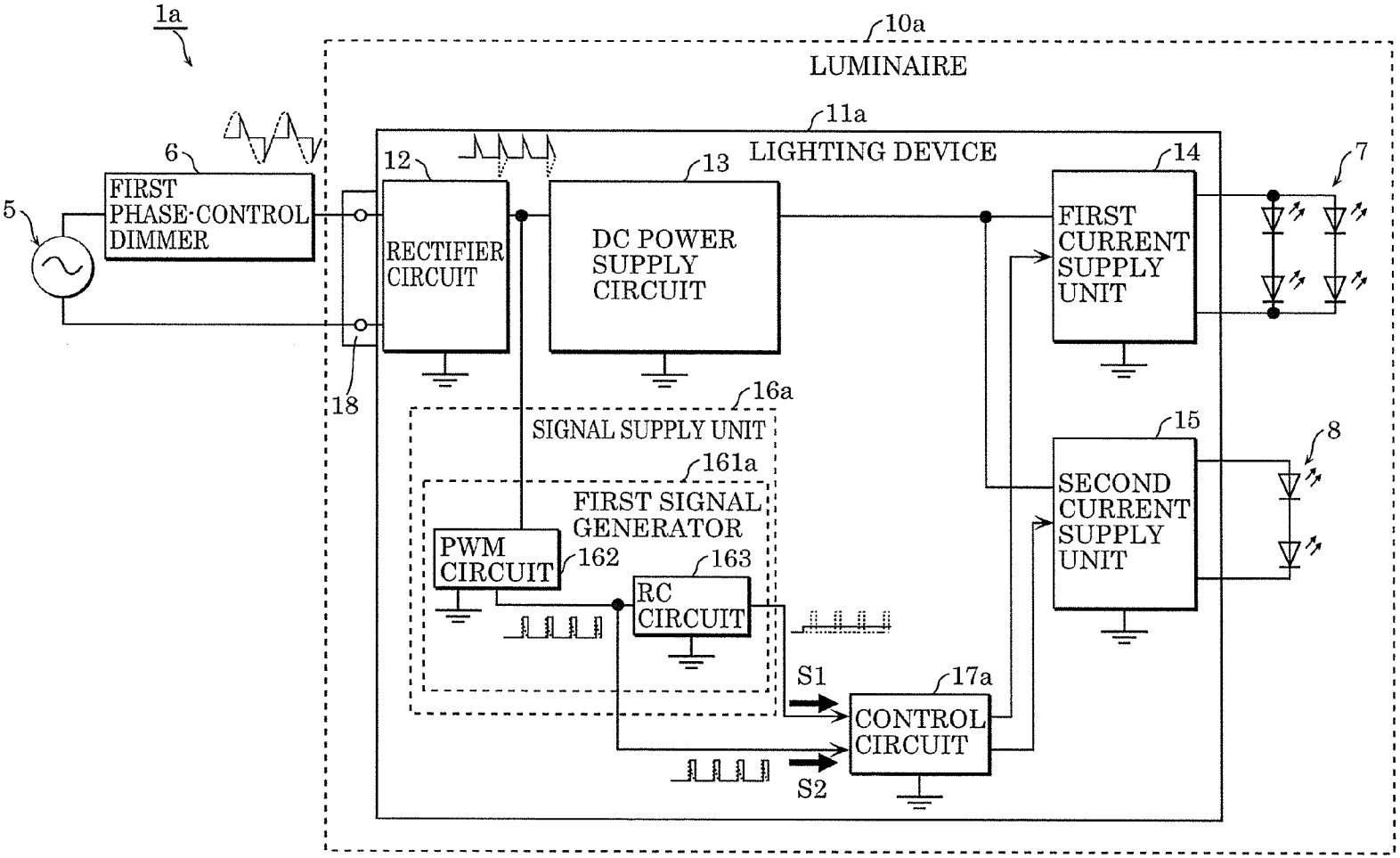
FIG. 6 is a block diagram of a functional configuration of a lighting system according to Variation of Embodiment 1.

FIG. 6 is a block diagram of a functional configuration of lighting system 1*a* according to Variation of Embodiment 1.

As FIG. 6 illustrates, lighting system 1*a* according to Variation of Embodiment 1 includes first phase-control dimmer 6 and luminaire 10*a*, similarly to lighting system 1 illustrated in FIG. 1. Similarly to luminaire 10 illustrated in FIG. 1, luminaire 10*a* according to Variation of Embodiment 1 includes: lighting device 11*a*, first light source unit 7 and second light source unit 8. Lighting device 11*a* according to Variation of Embodiment 1 is different from lighting device 11 illustrated in FIG. 1 in the configurations of signal supply unit 16*a* and control circuit 17*a*, and the other configurations are the same. As FIG. 6 illustrates, in lighting device 11*a* according to Variation of Embodiment 1, signal supply unit 16*a* inputs the PWM signal output from PWM circuit 162 of first signal generator 161*a* to control circuit 17*a* as second control signal S2. Control circuit 17*a* includes a function of reading the interval between edges of the PWM signal input as second control signal S2. The PWM signal output from PWM circuit 162 is synchronized with the full-wave rectified voltage of the phase-controlled AC voltage. Hence, for example, the interval between the rising edges of continuous pulses of the PWM signal is approximately the same as the half cycle of AC voltage. Accordingly, when the interval between the edges is greater than the half cycle of AC voltage, control circuit 17*a* determines that the switch of first phase-control dimmer 6 has been turned off. Accordingly, lighting device 11*a* according to Variation of Embodiment 1 is capable of obtaining second control information from second control signal S2 similarly to Embodiment 1.

[1-4. Advantageous Effects, Etc.]

As described above, lighting device 11 according to Embodiment 1 and lighting device 11*a* according to Variation of Embodiment 1 include: first input terminal 18 for receiving AC voltage phase-controlled by first phase-control dimmer 6; first current supply unit 14 which supplies the first current to first light source unit 7 which emits light of a first color; second current supply unit 15 which supplies the second current to second light source unit 8 which emits light of a second color different from the first color; control circuits 17 and 17*a* which control the total amount of light emitted from first light source unit 7 and second light source unit 8 and the color of combined light including the light emitted from first light source unit 7 and second light source unit 8 by adjusting the level the levels of the first current and the second current; and signal supply units 16 and 16*a* which supply a control signal to control circuit 17 and 17*a*. The control signal includes the first control information and the second control information. The first control information is for controlling the color of combined light, and corresponds to the conduction angle of first phase-control dimmer 6. The second control information is for controlling the total amount of light.

Accordingly, lighting devices 11 and 11*a* are capable of controlling the color of combined light based on the first control information corresponding to the conduction angle of first phase-control dimmer 6, and controls the total amount of light based on the second control information. In other words, lighting devices 11 and 11*a* are capable of outputting a desired total amount of light and a desired color of combined light, by adjustment of the first control information and the second control information.

In each of lighting devices 11 and 11*a*, the total amount of light has a positive correlation with the conduction angle.

Accordingly, lighting devices 11 and 11*a* are capable of providing a larger amount of light with an increase in conduction angle of first phase-control dimmer 6, similarly to a general dimmable lighting device. Moreover, in lighting devices 11 and 11*a*, the color of the combined light can also be changed accordingly by adjusting the conduction angle.

In lighting devices 11 and 11*a*, the second control information includes a value corresponding to the off period during which supply of the phase-controlled AC voltage is stopped in a time period longer than the half cycle of the AC voltage.

Accordingly, lighting devices 11 and 11*a* are capable of adjusting the total amount of light to a desired total amount and the color of combined light to a desired color simply by first phase-control dimmer 6. Hence, in lighting devices 11 and 11*a*, the total amount of light and the color of combined light can be adjusted arbitrarily with a simple configuration.

Moreover, in lighting devices 11 and 11*a*, when the off period is within a first range, control circuits 17 and 17*a* change the correspondence relationship between the first control information and the total amount of light.

Accordingly, lighting devices 11 and 11*a* are capable of changing the correspondence relationship between the color of combined light and the total amount of light by turning on and off first phase-control dimmer 6.

Moreover, in lighting devices 11 and 11*a*, when the first control information has a value within a first range and when the off period is within a second range, control circuits 17 and 17*a* set the correspondence relationship between the first control information and the total amount of light to a predetermined correspondence relationship.

Accordingly, when a plurality of lighting devices 11 and 11*a* are controlled by single first phase-control dimmer 6, the correspondence relationship between the total amount of light and the color of combined light of each lighting device 11 and 11*a* can be set to a predetermined relationship.

Moreover, in lighting devices 11 and 11*a*, when the off period is greater than or equal to a predetermined period, control circuits 17 and 17*a* store the correspondence relationship, between the first control information and the total amount of light, which is used immediately before supply of AC voltage is stopped, and when the supply of AC voltage is restarted, control circuits 17 and 17*a* control the total amount of light and the color of combined light based on the stored correspondence relationship.

Accordingly, lighting devices 11 and 11*a* are capable of storing the correspondence relationship, between the total amount of light and the color of combined light, used before turn-off, and thus, lighting devices 11 and 11*a* can be turned on with the correspondence relationship used before the turn-off.

Moreover, in lighting devices 11 and 11*a*, control circuits 17 and 17*a* control the color of combined light in coordination with the total amount of light based on the first control information, and controls the total amount of light based on the second control information.

Accordingly, lighting devices 11 and 11*a* are capable of controlling the color of combined light and the total amount of light which correspond to the first control information in coordination with each other, based on the second control information. Accordingly, lighting devices 11 and 11*a* are capable of outputting a desired combination of the total amount of light and the color of combined light, by determining in advance a correspondence relationship between the desired total amount of light and the desired color of combined light. For example, by setting the correspondence relationship between the total amount of light and the color of combined light to a correspondence relationship perceived as comfortable by humans, lighting devices 11 and 11*a* are capable of outputting light with a combination of the total amount of light and the color of combined light perceived as comfortable by humans.

Embodiment 2

Next, configurations of a lighting device, a luminaire, and a lighting system according to Embodiment 2 will be described.

In lighting device 11 according to Embodiment 1, the second control information is determined by the off period Toff of first phase-control dimmer 6. In Embodiment 2, instead of this, the second control information is determined by another dimmer.

The following mainly describes the differences between the lighting device and the like according to Embodiment 2 and lighting device 11 according to Embodiment 1. The descriptions of the common configurations are not given.

[2-1. Overall Configuration of Lighting System]

First, an overall configuration of a lighting system according to Embodiment 2 will be described referring to FIG. 7.

Figure 7:
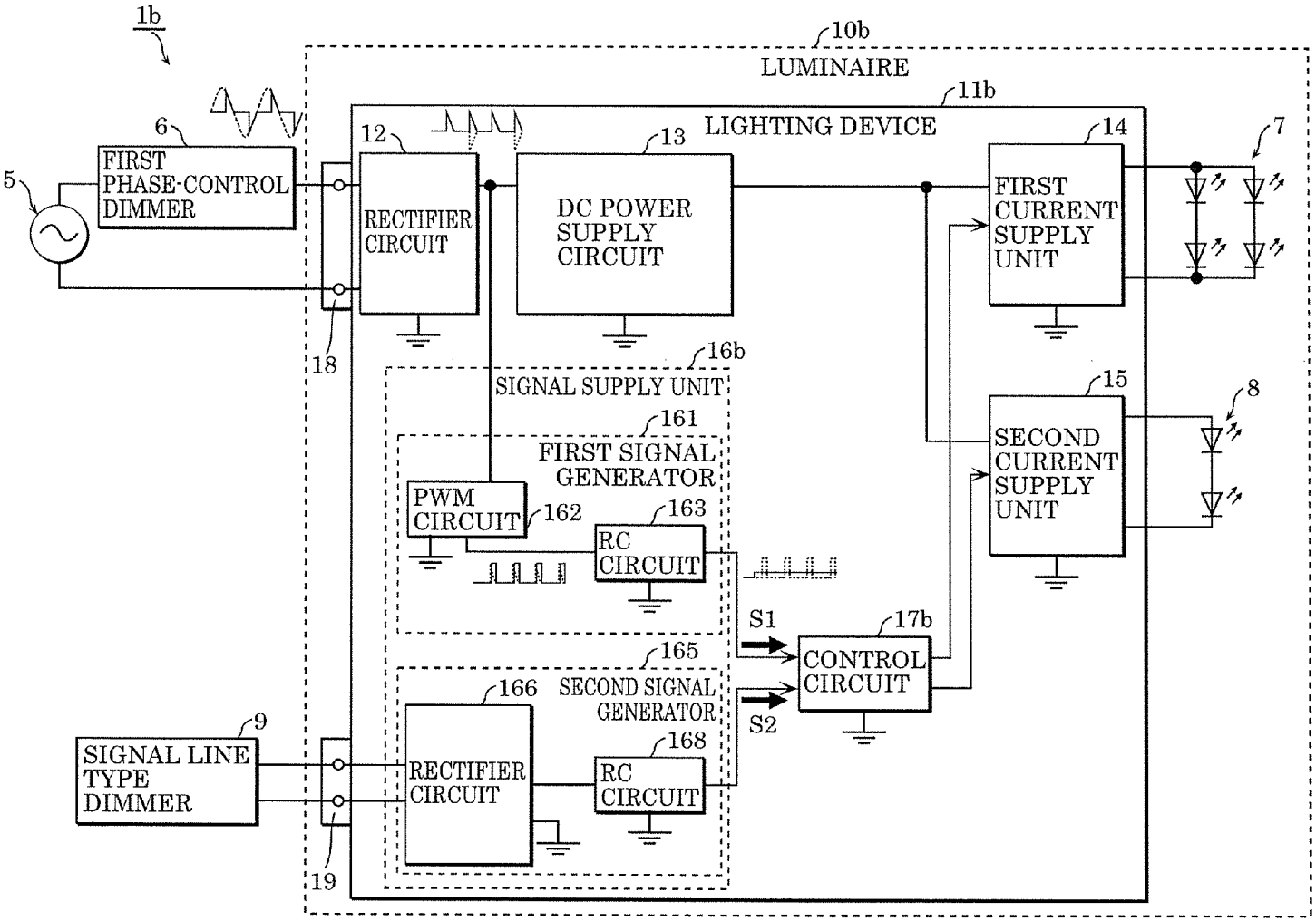
FIG. 7 is a block diagram of a functional configuration of a lighting system according to Embodiment 2.

FIG. 7 is a block diagram of a functional configuration of lighting system 1*b* according to Embodiment 2.

As FIG. 7 illustrates, lighting system 1*b* according to Embodiment 2 includes first phase-control dimmer 6 and luminaire 10*b*, similarly to lighting system 1 illustrated in FIG. 1. Lighting system 1*b* further includes signal line type dimmer 9.

Signal line type dimmer 9 is a signal generator which generates a dimming signal, and outputs the generated signal, via a signal line. In Embodiment 2, signal line type dimmer 9 outputs a PWM signal having a constant frequency and a variable duty ratio.

As FIG. 7 illustrates, luminaire 10*b* according to Embodiment 2 includes lighting device 11*b*, first light source unit 7, and second light source unit 8, similarly to luminaire 10 illustrated in FIG. 1. Lighting device 11*b* according to Embodiment 2 is different from lighting device 11 illustrated in FIG. 1 in that second input terminal 19 is included and the configurations of signal supply unit 16*b* and control circuit 17*b*. The other configurations are the same as those of lighting device 11.

Second input terminal 19 is a terminal for receiving an external signal. Second input terminal 19 according to Embodiment 2 inputs an external signal input from signal line type dimmer 9, to signal supply unit 16*b* of lighting device 11*b*.

Signal supply unit 16*b* is a circuit which supplies a signal to control circuit 17*b*. Signal supply unit 16*b* includes first signal generator 161 and second signal generator 165. First signal generator 161 is the same as first signal generator 161 according to Embodiment 1. Second signal generator 165 is a circuit which generates second control signal S2 based on the external signal input via second input terminal 19 from signal line type dimmer 9, and inputs the generated signal to control circuit 17*b*. Second signal generator 165 includes rectifier circuit 166 and RC circuit 168.

Rectifier circuit 166 is a circuit which rectifies a PWM signal input via second input terminal 19 from signal line type dimmer 9.

RC circuit 168 smoothes the PWM signal input from rectifier circuit 166, and inputs second control signal S2 which is DC voltage to control circuit 17*b*.

Control circuit 17*b* is different from control circuit 17 according to Embodiment 1 in that the DC voltage input as second control signal S2 is detected, and the other configurations are the same. Control circuit 17*b* obtains the value of DC voltage which is second control signal S2, as second control information. Since the other configurations of control circuit 17*b* are approximately the same as those of control circuit 17, descriptions thereof are omitted.

[2-2. Operation of Lighting Device]

Next, an operation of lighting device 11*b* according to Embodiment 2 will be described.

The operation of lighting device 11*b* according to Embodiment 2 is mainly different from the operation of lighting device 11 according to Embodiment 1 in that an external signal corresponding to second control signal S2 is input from signal line type dimmer 9. In lighting device 11*b* according to Embodiment 2, a second control signal which is the DC voltage corresponding to the PWM signal input from signal line type dimmer 9 is generated by second signal generator 165 and input to control circuit 17*b*. Control circuit 17*b* detects the value of the DC voltage as the second control information. Control circuit 17*b* then selects a characteristic table based on the second control information.

Here, as described above, the second control information is the value of the DC voltage corresponding to the PWM signal, and thus, the amount of information of the second control information depends on the resolution of the PWM signal. Accordingly, the amount of information of the second control information in lighting device 11*b* according to Embodiment 2 is greater than that in lighting device 11 according to Embodiment 1. Hence, Embodiment 2 provides increased flexibility of control. For example, in Embodiment 2, a larger number of characteristic tables than those in Embodiment 1 are stored in the memory of control circuit 17*b* and a desired characteristic table can be easily selected from among the characteristic tables. Moreover, control circuit 17*b* may store, in the memory, instead of the characteristic tables, formulas for calculating an output signal to first current supply unit 14 and an output signal to second current supply unit 15, based on the first control information and the second control information. Accordingly, the color of combined light and the total amount of light can be controlled with higher resolution.

In lighting device 11*b* according to Embodiment 2, it may also be that the characteristic table used before turn-off is stored and is used for next turn-on, similarly to lighting device 11 according to Embodiment 1.

[2-3 Advantageous Effects, Etc.]

As described above, lighting device 11*b* according to Embodiment 2 further includes second input terminal 19 for receiving an external signal. Signal supply unit 16*b* receives the external signal via second input terminal 19, and obtains the second control information from the external signal.

Accordingly, lighting device 11*b* is capable of controlling the total amount of light and the color of combined light with higher resolution.

Embodiment 3

Next, a lighting device, a luminaire, and a lighting system according to Embodiment 3 will be described.

In Embodiment 2, an external signal is input to lighting device 11*b* using signal line type dimmer 9. Lighting device 11*b* requires at least four lines externally connected. In Embodiment 3, an external signal is input to a lighting device by a second phase-control dimmer. Such a configuration allows only three lines to be externally connected to the lighting device.

The following mainly describes the differences between the lighting device and the like according to Embodiment 3 and lighting device 11 according to Embodiment 1. The descriptions of the common configurations are not given.

[3-1. Overall Configuration of Lighting System]

First, an overall configuration of a lighting system according to Embodiment 3 will be described referring to FIG. 8.

Figure 8:
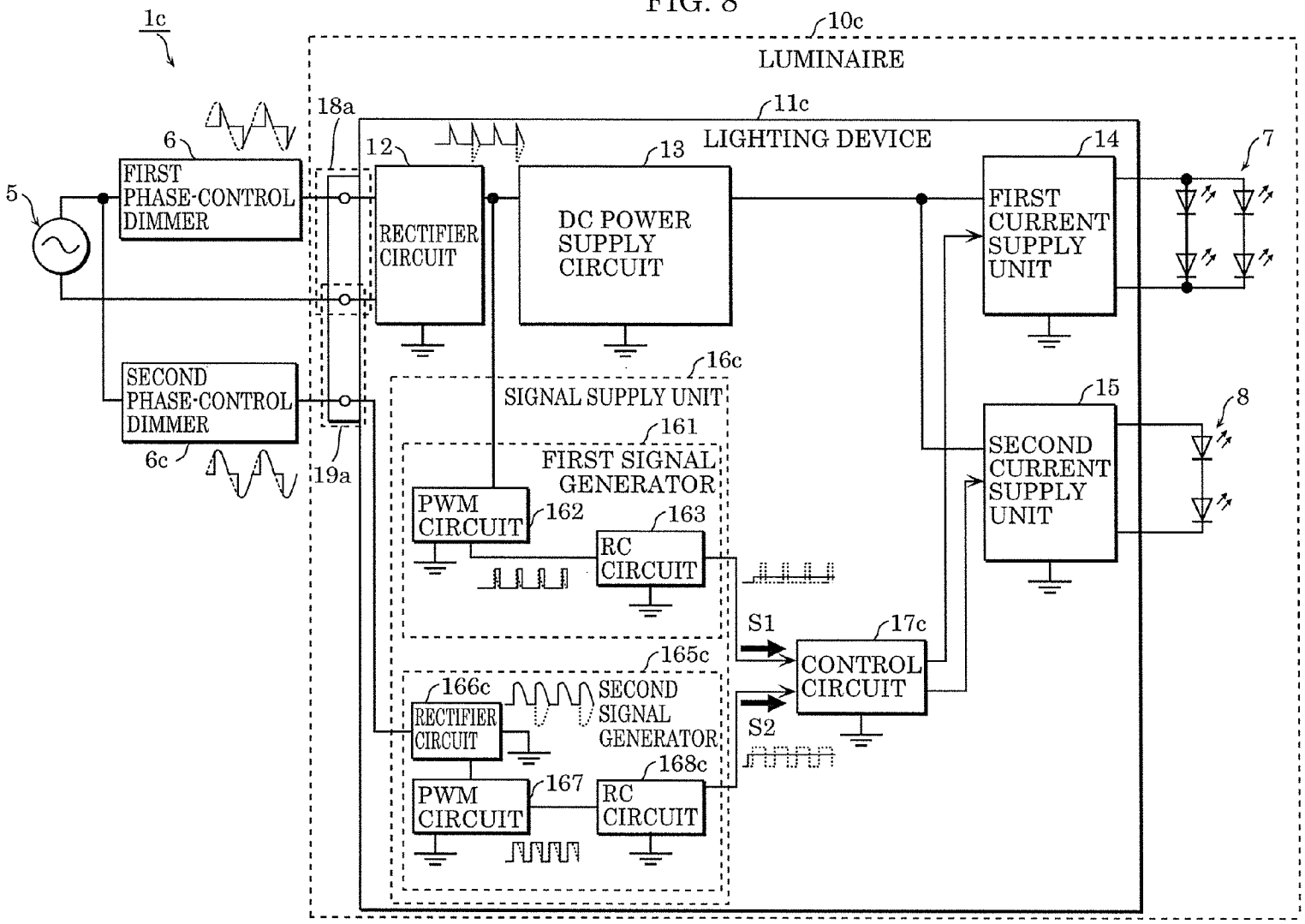
FIG. 8 is a block diagram of a functional configuration of a lighting system according to Embodiment 3.

FIG. 8 is a block diagram of a functional configuration of lighting system 1*c* according to Embodiment 3.

As FIG. 8 illustrates, lighting system 1*c* according to Embodiment 3 includes first phase-control dimmer 6 and luminaire 10*c*, similarly to lighting system 1 illustrated in FIG. 1. Lighting system 1*c* further includes second phase-control dimmer 6*c*.

Second phase-control dimmer 6*c* is a dimmer which performs phase control on the supplied AC voltage and outputs the phase-controlled AC voltage, similarly to first phase-control dimmer 6. In Embodiment 3, second phase-control dimmer 6*c* generates an external signal including second control information, and inputs the generated external signal to luminaire 10*c*.

As FIG. 8 illustrates, luminaire 10*c* according to Embodiment 3 includes lighting device 11*c*, first light source unit 7, and second light source unit 8, similarly to luminaire 10 illustrated in FIG. 1. Lighting device 11*c* according to Embodiment 3 is different from lighting device 11 illustrated in FIG. 1 in that the configuration of first input terminal 18*a*, second input terminal 19*a* is included, and the configurations of signal supply unit 16*c* and control circuit 17*c*. The other configurations are the same as those of lighting device 11.

First input terminal 18*a* is a terminal for receiving the AC voltage phase-controlled by first phase-control dimmer 6. First input terminal 18*a* includes two lines out of a three-line input terminal.

Second input terminal 19*a* is a terminal for receiving the AC voltage phase-controlled by second phase-control dimmer 6*c*. Second input terminal 19*a* includes two lines out of a three-line input terminal. As FIG. 8 illustrates, a line connected to first input terminal 18*a* is common to a line connected to second input terminal 19*a*. Such a configuration can be implemented by, as FIG. 8 illustrates, one of two output lines of AC power supply 5 is connected to first phase-control dimmer 6 and second phase-control dimmer 6*c*, and the other one of two output lines of AC power supply 5 is commonly used by first phase-control dimmer 6 and second phase-control dimmer 6*c* as a feedback line.

Signal supply unit 16*c* is a circuit which supplies a signal to control circuit 17*c*. Signal supply unit 16*c* includes first signal generator 161 and second signal generator 165*c*. First signal generator 161 is the same as first signal generator 161 according to Embodiment 1. Second signal generator 165*c* is a circuit which generates second control signal S2 based on the external signal input via second input terminal 19*a* from second phase-control dimmer 6*c*, and inputs the generated signal to control circuit 17*c*. Second signal generator 165*c* includes rectifier circuit 166*c*, PWM circuit 167, and RC circuit 168*c*. Rectifier circuit 166*c*, PWM circuit 167, and RC circuit 168*c* respectively include a circuit approximately the same as rectifier circuit 12, PWM circuit 162, and RC circuit 163. Accordingly, second signal generator 165*c* generates second control signal S2 including the DC voltage, based on the AC voltage phase-controlled by second phase-control dimmer 6*c*, and inputs the generated signal to control circuit 17*c*.

Since control circuit 17*c* has a configuration approximately the same as that of control circuit 17*b* according to Embodiment 2, the description thereof is omitted.

[3-2. Operation of Lighting Device]

Next, an operation of lighting device 11*c* according to Embodiment 3 will be described.

The operation of lighting device 11*c* according to Embodiment 3 is mainly different from the operation of lighting device 11 according to Embodiment 1 in that an external signal corresponding to second control signal S2 is input from second phase-control dimmer 6*c*. In lighting device 11*c* according to Embodiment 3, the second control signal which is the DC voltage corresponding to the phase-controlled AC voltage input from second phase-control dimmer 6*c* is generated by second signal generator 165*c*, and input to control circuit 17*c*. Control circuit 17*c* detects the value of the DC voltage as second control information. Control circuit 17*c* then selects a characteristic table based on the second control information.

In lighting device 11*c* according to Embodiment 3, the second control information is the value of the DC voltage corresponding to the phase-controlled AC voltage (that is, the conduction angle of second phase-control dimmer 6*c*). Hence, the amount of information of the second control information depends on the resolution of phase control. Accordingly, the amount of information of the second control information in lighting device 11*c* according to Embodiment 3 is greater than that in lighting device 11 according to Embodiment 1. Hence, similarly to lighting device 11*b* according to Embodiment 2, lighting device 11*c* according to Embodiment 3 is capable of performing highly flexible control. Details of the control are approximately the same as that in Embodiment 2, and thus, description thereof is not given.

[3-3 Advantageous Effects, Etc.]

As described above, lighting device 11*c* according to Embodiment 3 further includes second input terminal 19*a* for receiving an external signal. Signal supply unit 16*c* receives an external signal via second input terminal 19*a*, and obtains the second control information from the external signal. The external signal is the AC voltage phase-controlled by second phase-control dimmer 6*c*.

Accordingly, lighting device 11*c* is capable of controlling the color of combined light and the total amount of light with high resolution.

Moreover, in lighting device 11*c*, a line connected to first input terminal 18*a* is common to a line connected to second input terminal 19*a*.

Accordingly, only three lines are externally connected to lighting device 11*c*, which leads to a simple configuration.

Embodiment 4

Next, a lighting device, a luminaire, and a lighting system according to Embodiment 4 will be described.

The lighting device according to each of Embodiments 1 to 3 has a correspondence relationship between the total amount of light and the color of combined light as illustrated in FIG. 2, and the total amount of light and the color of combined light are controlled in coordination with each other based on the first control information. A lighting device according to Embodiment 4 is capable of controlling the total amount of light and the color of combined light separately.

The following mainly describes the differences between the lighting device and the like according to Embodiment 4 and lighting device 11 according to Embodiment 1. The descriptions of the common configurations are not given.

[4-1. Overall Configuration of Lighting System]

First, an overall configuration of a lighting system according to Embodiment 4 will be described referring to FIG. 9.

Figure 9:
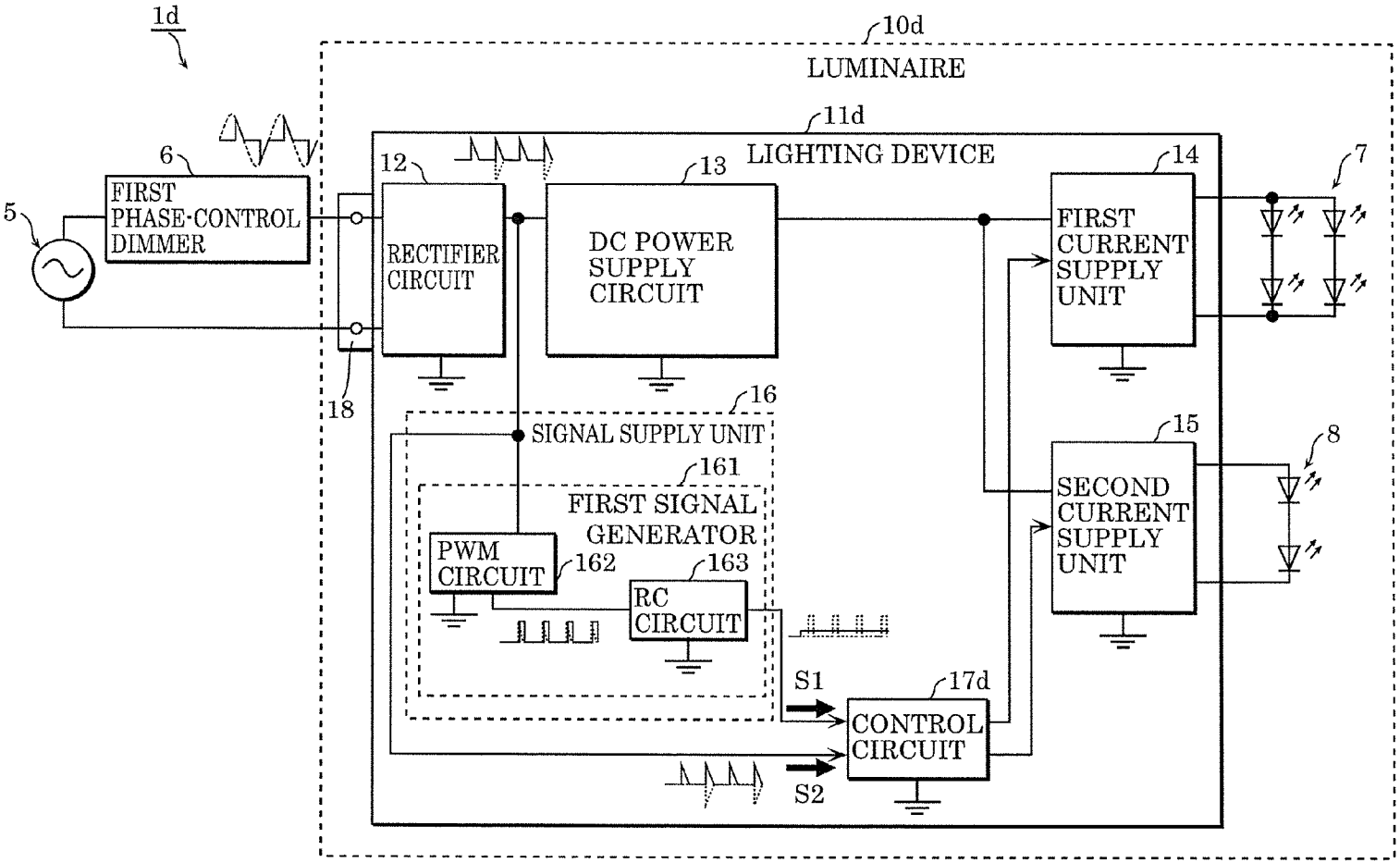
FIG. 9 is a block diagram of a functional configuration of a lighting system according to Embodiment 4.

FIG. 9 is a block diagram of a functional configuration of lighting system 1*d* according to Embodiment 4.

As FIG. 9 illustrates, lighting system 1*d* according to Embodiment 4 includes first phase-control dimmer 6 and luminaire 10*d*, similarly to lighting system 1 illustrated in FIG. 1.

As FIG. 9 illustrates, luminaire 10*d* according to Embodiment 4 includes lighting device 11*d*, first light source unit 7, and second light source unit 8, similarly to luminaire 10 illustrated in FIG. 1. Lighting device 11*d* according to Embodiment 4 is different from lighting device 11 illustrated in FIG. 1 in the configuration of control circuit 17*d*, and the other configurations are the same as those of lighting device 11.

Control circuit 17*d* is different from control circuit 17 according to Embodiment 1 in the details of characteristic tables stored in the memory, and the other configurations are the same. Similarly to the characteristic tables stored in control circuit 17 according to Embodiment 1, each of the characteristic tables stored in the memory of control circuit 17*d* also indicates a relationship between first control information, an output signal to first current supply unit 14, and an output signal to second current supply unit 15. However, each characteristic table stored in the memory of control circuit 17*d* according to Embodiment 4 is used for emission of combined light of single color. In each characteristic table, only the total amount of light mainly varies. Control circuit 17*d* selects one characteristic table based on second control information, and determines the total amount of light based on the first control information.

Accordingly, it can be said that control circuit 17*d* mainly controls the total amount of light based on the first control information and the color of combined light based on the second control information. The characteristic tables stored in control circuit 17*d* will be described in the following description of the operation of lighting device 11*d*.

[4-2. Operation of Lighting Device]

Next, an operation of lighting device 11*d* according to Embodiment 4 will be described.

Here, the characteristic tables which are one difference between lighting device 11*d* according to Embodiment 4 and lighting device 11 according to Embodiment 1 will be mainly described.

First, a correspondence relationship, between the total amount of light and the color of combined light emitted from lighting device 10*d*, determined based on one of the characteristic tables stored in control circuit 17*d* will be described referring to FIG. 10.

Figure 10:
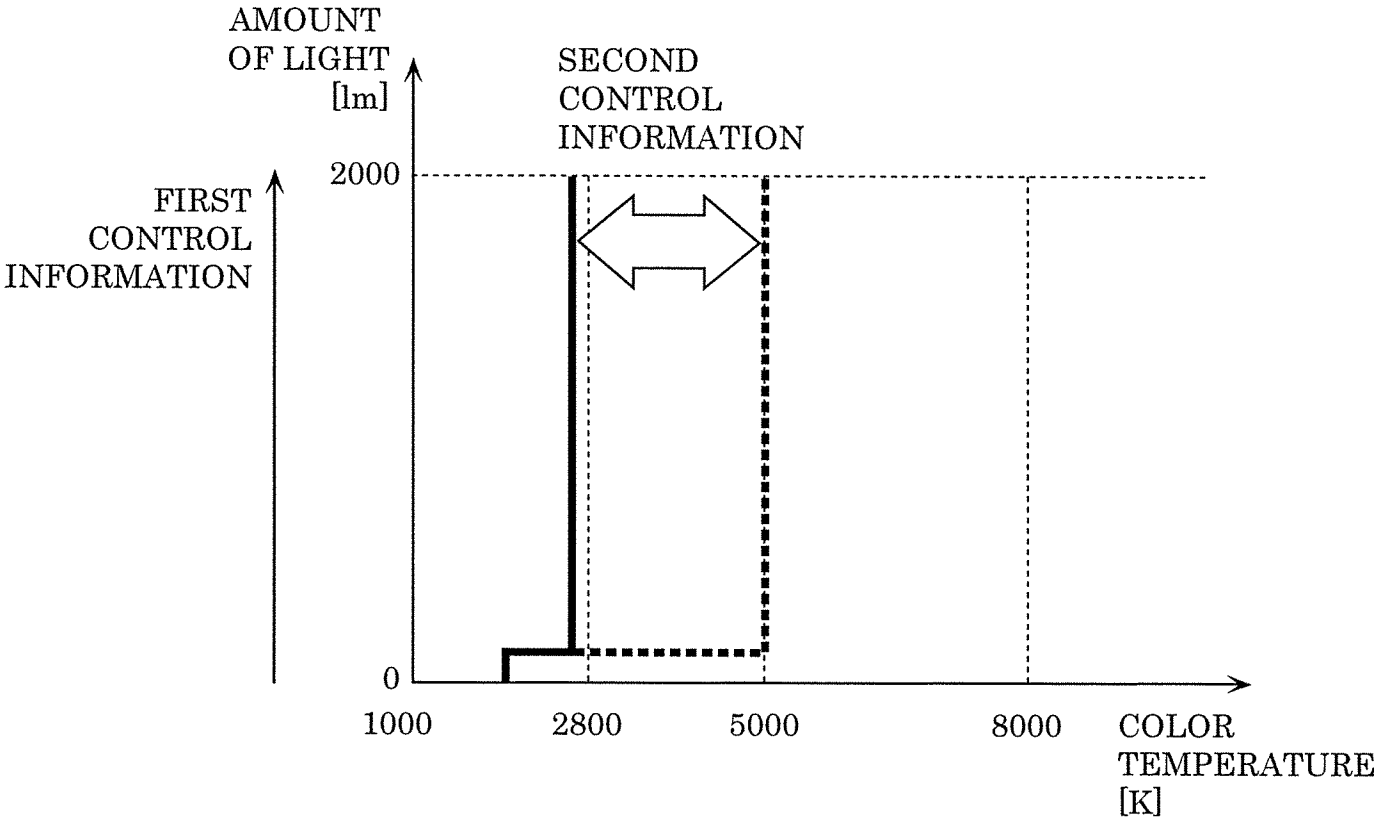
FIG. 10 is a graph illustrating correspondence relationships between the total amount of light output from a luminaire according to Embodiment 4 and the color of combined light output from the luminaire.

FIG. 10 is a graph illustrating correspondence relationships between the total amount of light and the color of combined light emitted from lighting device 10*d* according to Embodiment 4. The graph of FIG. 10 illustrates correspondence relationships between the total amount of light and the color of combined light corresponding to two characteristic tables indicated by a solid line and a dashed line.

As FIG. 10 illustrates, the color of combined light corresponding to each characteristic table is approximately the same except in the range where the total amount of light is very small. Moreover, as FIG. 10 illustrates, in lighting device 11*d* according to Embodiment 4, the total amount of light is mainly controlled based on the first control information.

Accordingly, lighting device 11*d* according to Embodiment 4 selects one characteristic table, that is, selects one color of combined light based on the second control information, and controls the total amount of light based on the first control information.

In the correspondence relationships between the total amount of light and the color of combined light illustrated in FIG. 10, the color of combined light is controlled so as to be 2000 K in the range where the total amount of light is very small. Accordingly, lighting device 11*d* supplies current only to first light source unit 7 which emits light having a color temperature of 2000 K. Such a control is performed because when the amount of light output from lighting device 10*d* is small, it is known that light output of a low color temperature of approximately 2000 K is perceived as comfortable by humans.

The other operations of lighting device 11*d* according to Embodiment 4 are approximately the same as the operations of lighting device 11 according to Embodiment 1, and thus, the descriptions thereof are omitted.

[4-3 Advantageous Effects, Etc.]

As described above, lighting device 11*d* according to Embodiment 4 includes: first input terminal 18 for receiving AC voltage phase-controlled by first phase-control dimmer 6; first current supply unit 14 which supplies first current to first light source unit 7 which emits light of a first color; second current supply unit 15 which supplies second current to second light source unit 8 which emits light of a second color different from the first color; control circuit 17*d* which controls the total amount of the light emitted from first light source unit 7 and second light source unit 8 and the color of combined light including the light emitted from first light source unit 7 and second light source unit 8 by adjusting the levels of the first current and the second current; and signal supply unit 16 which supplies a control signal to control circuit 17*d*. The control signal includes the first control information and the second control information. The first control information is for controlling the total amount of light, and corresponds to the conduction angle of first phase-control dimmer 6. The second control information is for controlling the color of combined light.

Accordingly, lighting device 11*d* is capable of controlling the total amount of light and the color of combined light separately, and thus, a desired combination of the total amount of light and the color of combined light is achievable.

Moreover, in lighting device 11*d*, control circuit 17*d* sets the second current to zero when the conduction angle is less than or equal to a predetermined value.

Accordingly, when a light source which emits light of a color temperature lower than the color temperature of the light emitted from second light source 8 is used as first light source unit 7, light of a low color temperature is emitted when the amount of light emitted is small. Hence, dimming and color control perceived as comfortable by the user can be achieved.

Moreover, in lighting device 11*d*, when off period Toff is within a first range, control circuit 17*d* changes the correspondence relationship between the first control information and the color of combined light.

Accordingly, lighting device 11*d* is capable of changing the correspondence relationship between the total amount of light and the color of combined light by turning on and off first phase-control dimmer 6.

Moreover, in lighting device 11*d*, when the first control information has a value within a first range and the off period is within the second range, control circuit 17*d* sets the correspondence relationship between the first control information and the color of combined light to a predetermined correspondence relationship.

Accordingly, when a plurality of lighting devices 11*d* are controlled by single first phase-control dimmer 6, it is possible to set the correspondence relationship between the total amount of light and the color of combined light in each lighting device 11*d* to a predetermined correspondence relationship.

Moreover, in lighting device 11*d*, when the off period Toff is greater than or equal to a predetermined time period, control circuit 17*d* stores the correspondence relationship, between the first control information and the total amount of light, obtained immediately before supply of AC voltage is stopped. When supply of AC voltage is restarted, control circuit 17*d* controls the total amount of light and the color of combined light based on the stored correspondence relationship.

Accordingly, lighting device 11*d* is capable of storing the correspondence relationship, between the total amount of light and the color of combined light, used before turn-off. Accordingly, lighting device 11*d* can be turned on with the correspondence relationship before the turn-off.

Variations etc.

The lighting device, the luminaire, and the lighting system according to the present disclosure have been described based on Embodiments 1 to 4, however, the present disclosure is not limited to such embodiments. Those skilled in the art will readily appreciate that various modifications may be made in the above embodiments without materially departing from the principles and spirit of the inventive concept, the scope of which is defined in the appended Claims and their equivalents.

For example, in each embodiment described above, LED modules are used as first light source unit 7 and second light source unit 8. However, first light source unit 7 and second light source unit 8 are not limited to such LED modules. Any light sources can be used as long as the amount of light emitted can be adjusted by current control. For example, first light source unit 7 and second light source unit 8 each may be an LED chip, or other types of light sources such as an organic electro-luminescence element.

Moreover, in each embodiment described above, light sources emit white light having different color temperatures. However, light sources other than the light sources which emit white light may be used. For example, a light source which emits light of single color may be used.

Moreover, in each embodiment described above, the control circuit controls the total amount of light and the color of combined light based on a characteristic table. However, the control circuit may use a function which indicates a relationship between control information, the total amount of light, and the color of combined light.

Moreover, in each embodiment described above, first phase-control dimmer 6 includes a switch. However, no switch may be included in first phase-control dimmer 6. For example, on and off of supply of AC voltage to the lighting device may be switched by operating a dial or the like included in first phase-control dimmer 6. This simplifies the configuration of first phase-control dimmer 6.

Moreover, in Embodiments 1 and 4, first control signal S1 and second control signal S2 are input to the control circuit. However, only one control signal (for example, first control signal S1) may be input to the control circuit. For example, the control circuit is also capable of obtaining the first control information and the second control information from one control signal. However, when the time constant of RC circuit 163 according to Embodiments 1 and 4 is large, the off period Toff could fail to be property detected in first control signal S1. Accordingly, when the time constant of RC circuit 163 is large, use of two control signals is effective.

Moreover, a combination of the type of the signal output from signal line type dimmer 9 and the configuration of second signal generator 165 according to Embodiment 2 may be other than that described in Embodiment 2. Any configuration is possible as long as the control circuit obtains the second control information from second control signal S2 output from second signal generator 165.

Moreover, in Embodiment 2, lighting device 11*b* receives an external signal via a signal line from signal line type dimmer 9, but how the external signal is received is not limited to the above example. For example, it may be that a receiving element is included for receiving a wireless signal including an external signal and outputting the external signal to second input terminal 19. Accordingly, the external signal can be transmitted to the lighting device by a wireless signal, which increases the flexibility of layout of the lighting device and the dimmer.

Moreover, it may be that the correspondence tables stored in control circuit 17*d* of lighting device 11*d* according to Embodiment 4 may be stored in each control circuit according to Variation of Embodiment 1, and Embodiments 2 and 3.

Moreover, in Embodiment 4, when the total amount of light is small, lighting device 11*d* turns on only first light source unit 7. However, even if the total amount of light is small, first light source unit 7 and second light source unit 8 may be turned on so as to obtain the same color of combined light as that obtained when the total amount of light is large.

While the foregoing has described what are considered to be the best mode and/or other examples, it is understood that various modifications may be made therein and that the subject matter disclosed herein may be implemented in various forms and examples, and that they may be applied in numerous applications, only some of which have been described herein. It is intended by the following claims to claim any and all modifications and variations that fall within the true scope of the present teachings.

What is claimed is:

1. A lighting device comprising:

a first input terminal for receiving an AC voltage phase-controlled by a first phase-control dimmer;

a first current supply unit configured to supply a first current to a first light source unit which emits light of a first color;

a second current supply unit configured to supply a second current to a second light source unit which emits light of a second color different from the first color;

a control circuit which controls a total light amount and a color of combined light by adjusting a level of the first current and a level of the second current, the total light amount being a total amount of the light emitted from the first light source unit and the light emitted from the second light source unit, the combined light including the light emitted from the first light source unit and the light emitted from the second light source unit; and a signal supply unit configured to supply a control signal to the control circuit, wherein the control signal includes first control information and second control information, the first control information is information for controlling either one of the total light amount and the color of the combined light, and corresponds to a conduction angle of the first phase-control dimmer, and the second control information is information for controlling an other one of the total light amount and the color of the combined light.

2. The lighting device according to claim 1, wherein the total light amount has a positive correlation with the conduction angle.

3. The lighting device according to claim 1, wherein the control circuit sets the level of the second current to zero when the conduction angle is less than or equal to a predetermined value.

4. The lighting device according to claim 1, wherein the second control information includes a value corresponding to an off period during which supply of the AC voltage having the phase controlled is stopped over a time period greater than a half cycle of the AC voltage.

5. The lighting device according to claim 4, wherein the control circuit changes a correspondence relationship between the first control information and the other one of the total light amount and the color of the combined light, when the off period is within a first range.

6. The lighting device according to claim 4, wherein the control circuit sets a correspondence relationship between the first control information and the other one of the total light amount and the color of the combined light to a predetermined correspondence relationship, when the first control information has a value within a first range and the off period is within a second range.

7. The lighting device according to claim 4, wherein the control circuit: stores a correspondence relationship between the first control information and the other one of the total light amount and the color of the combined light, when the off period is greater than or equal to a predetermined period; and controls the total light amount and the color of the combined light based on the correspondence relationship stored, when supply of the AC voltage is restarted, the correspondence relationship stored being obtained immediately before the supply of the AC voltage is stopped.

8. The lighting device according to claim 1, further comprising a second input terminal for receiving an external signal, wherein the signal supply unit is configured to receive the external signal via the second input terminal, and obtain the second control information from the external signal.

9. The lighting device according to claim 8, further comprising a receiving element for receiving a wireless signal including the external signal and outputting the external signal to the second input terminal.

10. The lighting device according to claim 9, wherein the external signal is an AC voltage phase-controlled by a second phase-control dimmer.

11. The lighting device according to claim 8, wherein the first input terminal is connected to a line which is commonly connected to the second input terminal.

12. The lighting device according to claim 1, wherein the control circuit controls the total light amount in coordination with the color of the combined light based on the first control information, and controls the total light amount based on the second control information.

13. A luminaire comprising:

the lighting device according to claim 1; and the first light source unit and the second light source unit.

14. A lighting system comprising:

the luminaire according to claim 13; and the first phase-control dimmer.

* * * * *